US005931479A

United States Patent [19]

Benoit et al.

[11] Patent Number: 5,931,479

[45] Date of Patent: Aug. 3, 1999

[54] ROLLER SKATE

[75] Inventors: Louis Benoit, La Balme De Sillingy; Olivier Senee, Annecy, both of France

[73] Assignee: Salomon S.A., Metz-Tessy, France

[21] Appl. No.: 08/752,597

[22] Filed: Nov. 19, 1996

[30] Foreign Application Priority Data

Nov. 20, 1995 [FR] France ..... 95 13899

[51] Int. Cl.[6] ..... A63C 17/04

[52] U.S. Cl. ..... 280/11.23; 280/11.19; 280/11.22

[58] Field of Search ..... 280/11.19, 11.22, 280/11.23, 11.2, 7.13; 36/113, 114, 115

[56] References Cited

U.S. PATENT DOCUMENTS

| | | | |
|---|---|---|---|
| D. 391,317 | 2/1998 | Robinette | D21/226 |
| 3,807,062 | 4/1974 | Spier | 36/2.5 AL |
| 4,275,895 | 6/1981 | Edwards | 280/11.2 |
| 5,171,033 | 12/1992 | Olson et al. | 280/11.22 |
| 5,177,884 | 1/1993 | Rullier | 36/117 |
| 5,251,920 | 10/1993 | McHale | 280/11.19 |
| 5,331,752 | 7/1994 | Johnson et al. | 36/115 |
| 5,393,077 | 2/1995 | Wanous | 280/11.22 |
| 5,398,948 | 3/1995 | Mathis | 280/11.19 |
| 5,437,466 | 8/1995 | Meibock et al. | 280/11.22 |
| 5,446,976 | 9/1995 | Donnadieu et al. | 36/117 |
| 5,727,796 | 3/1998 | Zhang | 280/7.13 |

FOREIGN PATENT DOCUMENTS

| | | | |
|---|---|---|---|
| 0465222 | 1/1992 | European Pat. Off. | A43B 5/16 |
| 0465223 | 1/1992 | European Pat. Off. | A43B 5/16 |
| 2668072 | 4/1992 | France | A63C 1/00 |
| WO95/15094 | 6/1995 | WIPO . | |

OTHER PUBLICATIONS

Nike Catalog, Spring 1998, two pages.

*Primary Examiner*—Lanna Mai
*Assistant Examiner*—Michael Cuff
*Attorney, Agent, or Firm*—Greenblum & Bernstein, P.L.C.

[57] ABSTRACT

The invention relates to a roller skate boot, of the type constituted by an upper provided with a rear stiffener, and including a rigid collar journalled on the rear stiffener of the boot and adapted to surround the lower part of the leg. According to the invention, the upper of the boot is a low upper, and the journal of the rigid collar on the upper is located at the level of the upper end thereof, and substantially at the level of the malleoli.

36 Claims, 4 Drawing Sheets

ROLLER SKATE

BACKGROUND OF THE INVENTION

1. Field of the Invention

The present invention relates to a roller skate, and more particularly to an in-line roller skate.

2. Background and Material Information

Roller skates of this type, derived from ice skating, are usually constituted by a high upper forming a shell made of a rigid synthetic material extending up to the ankle and overlaid by a collar, also made of a rigid synthetic material, surrounding the leg of the skater for lateral or transverse stability thereof, and fixed on the upper by two lateral journalled axes.

Such skates have the disadvantage of being "hot" and of is not providing any ventilation for the foot, resulting in a substantial transpiration, especially when skating under external high temperatures.

These skates are also uncomfortable due to the rigidity of the shell and of the collar constituting the upper and preventing any movement of the ankle with respect to the foot, such a rigidity being advisable for an optimum holding of the ankle with the respect to the foot.

SUMMARY OF THE INVENTION

The object of the present invention is to provide a skate equipped with an improved boot, resolving both the problems of comfort and of ventilation of the foot, while maintaining the necessary transverse stability and holding of the ankle.

This goal is achieved, according to the invention, by the fact that the boot has a low upper made of flexible material, and provided with a rear stiffener made of a rigid material, and by the fact that it has a rigid collar capable of surrounding the ankle of the user, and journalled on the stiffener of the upper, at the upper end thereof so as to pivot freely from front-to-rear, and at least frontwardly, with respect to the upper.

Such an arrangement allows for a total independence is during the rotation of the collar with respect to the upper, and therefore a great freedom for a front/rear flexion of the leg, while providing the foot retention and the necessary foot/ankle transverse stability.

Moreover, this freedom of rotation of the collar allows for a greater upward extension thereof, and therefore a better lateral leg/ankle retention.

According to an advantageous embodiment, the journal of the rigid collar on the upper is located substantially in the malleoli area. Therefore, the journal of the collar corresponds substantially to the natural joint of the leg on the foot, and there is no offset between the axis of these journals.

BRIEF DESCRIPTION OF THE DRAWINGS

In any event, the invention will be better understood and other characteristics thereof will become apparent by means of the following description, with reference to the annexed drawings illustrating a plurality of embodiments, by way of non-limiting, and in which.

DETAILED DESCRIPTION OF THE PREFERRED EMBODIMENTS

Figure 1:
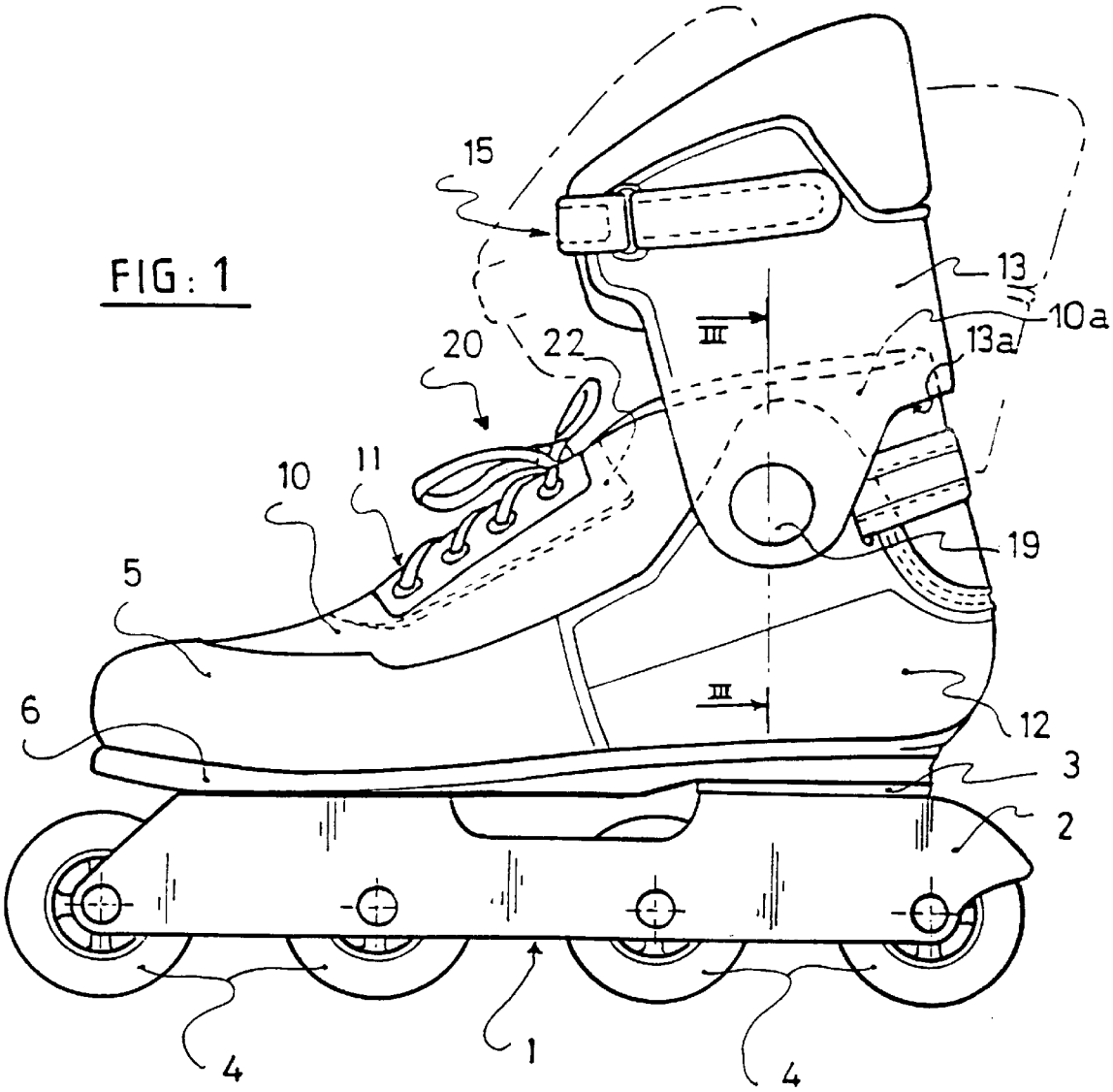
FIG. 1 is a side view of the boot according to the invention.

The skate shown in FIG. 1 includes a frame 1 with a U-shaped transverse section and constituted by two lateral flanges 2 on which the wheels 4 are affixed. The skate also includes a boot 5 which is attached with respect to the frame through its sole 6 at both the heel and toe areas. For the heel area a mounting plate 3 is shown.

The boot 5 has the external appearance of a normal low boot, and is thus constituted by a low flexible upper 10, i.e., an upper whose rigid portions do not extend upwardly beyond the malleoli, provided on its front portion with an opening 11 for passage of the foot and with a lacing system 20 of a known type, for closing the boot and tightening the foot The upper 10 is provided in the heel area with a rigid rear stiffener 12, which can be made in any known manner, and in fact constitutes the only rigid portion of the upper.

This stiffener 12 is preferably made of a rigid synthetic material, and extends over the entire rear portion of the boot around the heel thereof.

This stiffener 12 extends, in the malleoli area, up to the top of the upper, for receiving a journalled collar 13, and externally has at the level of the malleoli a boss 12*a* projecting outwardly and extending substantially perpendicular to the wall of the stiffener.

Figure 4:
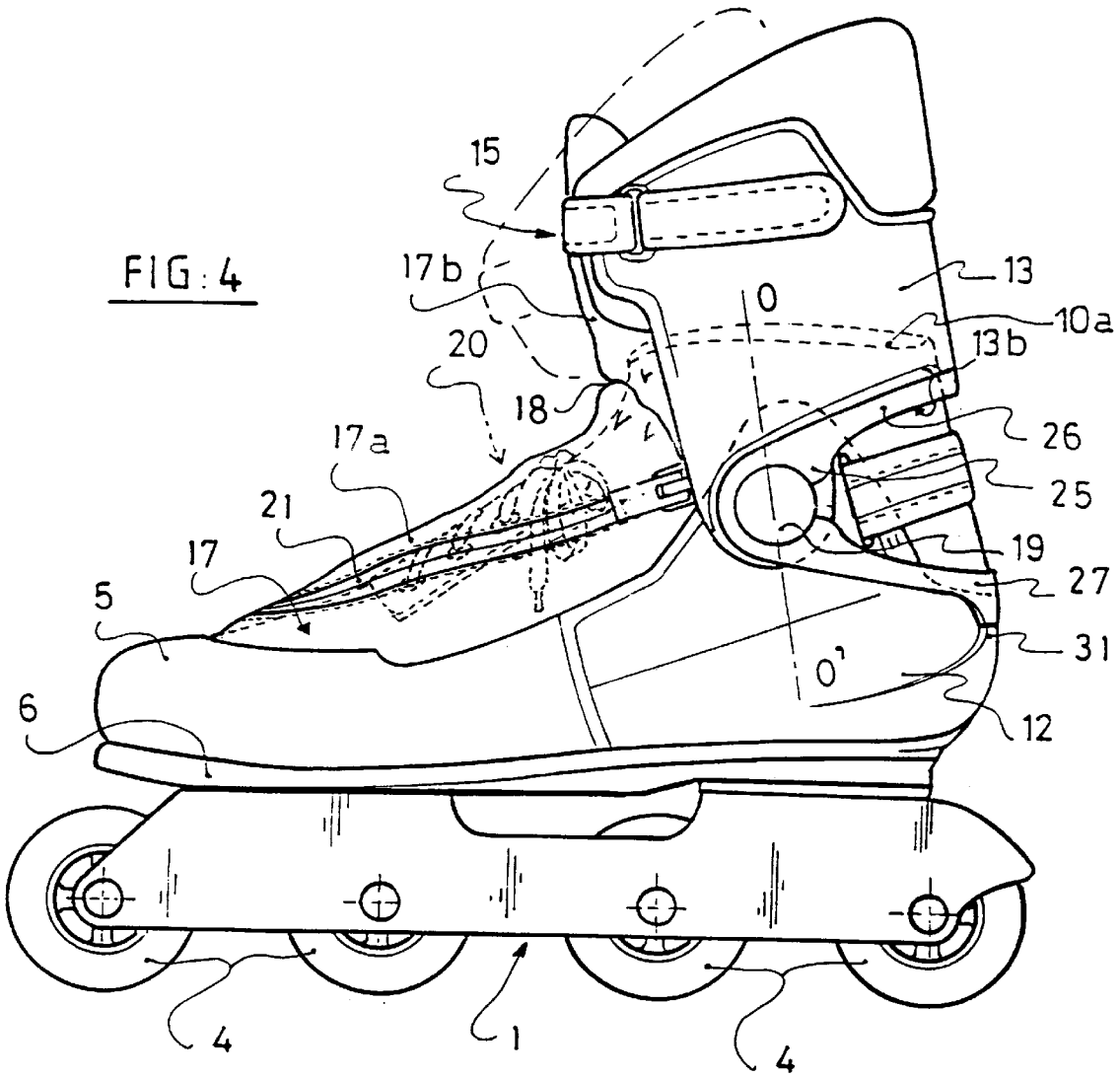
FIG. 4 is a perspective view of a boot according to another embodiment

Each boss 12*a* is further provided with a hole 12*b* for the journalled mounting of the collar 13 by means of studs 19 (see, FIG. 4).

These studs 19 serve to stop the collar 13 whereas the bosses 12*a* define the axis of rotation 30 of this collar on the upper.

It will be noted that the studs 19 can be replaced by any other connection-means allowing a rotation, such as rivets. However, the use of studs 19 is particularly advantageous because it allows for a mounting by merely applying pressure, without requiring a counter-element as is the case with rivets, which makes it possible to considerably simplify the manufacturing, since the collar can then be mounted during the last step of the boot manufacturing.

Furthermore, the studs 19 will be advantageously constituted by a relatively flexible material with respect to a metal rivet, such as delrin, so that their head 19*a* follows the possible deformations of the rigid collar 13, for example, when a torsion of the leg occurs, such a construction making it possible to avoid the pulling of these nails during such a torsion.

Of course, the journalled collar 13 could also be mounted according in another manner, by allowing for easy disassembly, and for example by means of bayonet or ratchet systems, which are known and not described hereinafter, for setting the collar or using the boot with a simple low upper.

The journalled collar 13 is constituted by a cuff made of a rigid material and especially a synthetic material such as pebax.

This collar 13 extends upwardly up to the base of the is calf and surrounds the entire lower part of the leg. It is opened at its front portion to allow the positioning of the foot in the boot, and is provided with known tightening means 15, and constituted by auto-gripping means, for example.

Furthermore, this collar 13 is provided at the rear with a scallop 13*a* adapted to facilitate the rearward rotation of this collar (see position in dotted lines in FIG. 1).

As it will be easily understood, the substantial height of the collar 13 allows for an excellent lateral leg retention when skating, such a height further enabling a greater distribution, of the reaction forces on the leg, and consequently a better comfort for the user.

However, such height for the collar 13 does not hinder the rear/front flexional movements of the leg with respect to the foot, and can even be increased, for example, up to mid-leg so as to decrease the forces on the leg.

Indeed, the total and independent journal of the collar 13 on the upper enables the latter one to pivot freely, with no flexional limitation by the upper and with no hindrance for the user. In fact, the tongue 22 of the boot does not extend upwardly beyond the flexional fold of the foot of the user so as not to hinder the flexion thereof, nor the pivoting of the collar.

Surprisingly, such a freedom in the motion of the ankle has proved not to be detrimental to the lateral holding of the ankle to perform this type of skating, while offering a clearly improved comfort and with no hard spot with respect to the conventional skate boots. Moreover, the flexible structure of the upper of the boot, preferably made of an aerated textile material, allows to avoid transpiration problems related to the use of "non-breathable" plastic materials, and therefore offers a double comfort, with respect to both the aeration and the tightening of the foot obtained by means of flexible portions. In such a construction, the very rigid sole 6 also contributes to the foot retention.

Figure 2:
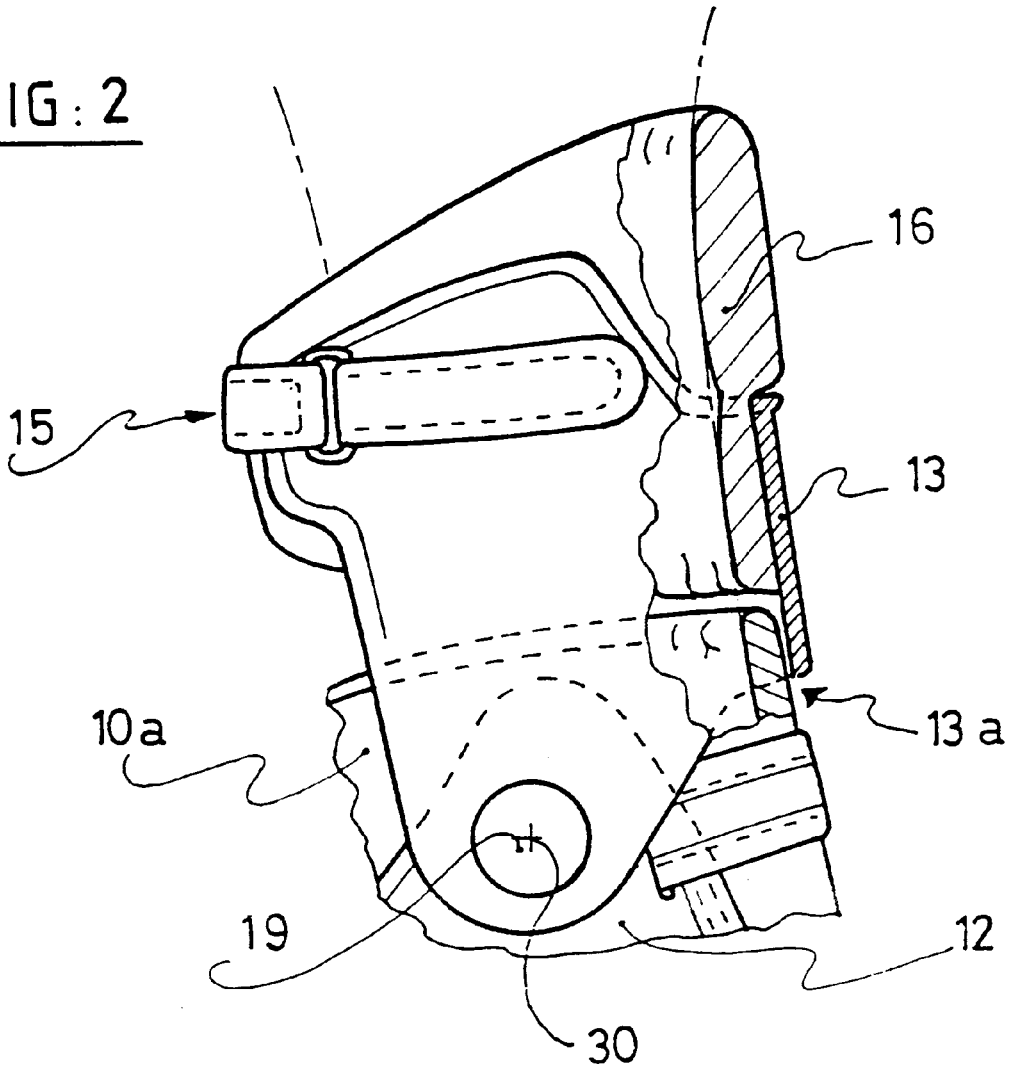
FIG. 2 is a partial longitudinal cross-sectional view of a detail of FIG. 1.
Figure 3:
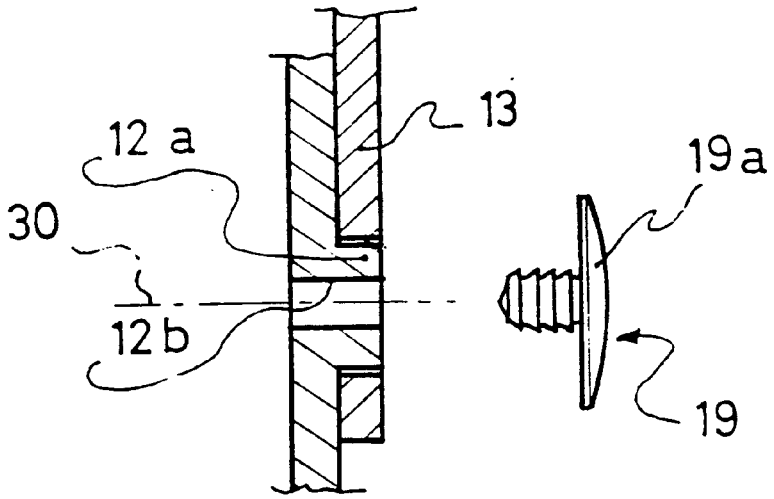
FIG. 3 is a partial cross-sectional view along the line III—III of FIG. 1.

To further increase the comfort of such skate, and as shown in FIG. 2, the collar 13 is provided internally with a lining 16 intended for the comfort of the leg and interrupted in the area 13*a* for covering the lower portion of the collar 13 and the upper portion 10*a* of the upper 10, so as to avoid any excessive thickness in this area. The comfort portion of the collar is "borne" thereon so that its pivoting can not be disturbed by a comfort portion originating from the upper. One will note that in the case shown, the extreme upper portion 10*a* of the upper extends in fact slightly above the rear stiffener 12, and therefore above the malleoli, to ensure a continuity of the upper/collar, but such a construction is not a hinderance since this portion 10*a* is not rigid and is intended only for the comfort. Therefore, such a portion 10*a* does not at all disturb the flexion of the leg and could be eliminated as well.

Of course, and for comfort purposes, the lining 16 is designed so as to extend in the extension of the internal surface of the upper.

FIG. 4 shows a skate similar to that of FIG. 1, and for which the same elements will be designated by the same reference numerals.

The only differences between this skate and that previously shown reside in the provision on the boot of a cover 17 and of a return device or element 25 of the collar.

As shown in this FIG. 4, the cover 17 is constituted by two portions 17*a*, 17*b* extending over the top of the upper by covering the lacing system, and over the front of the lower part of the leg, respectively, so as to block the opening defined by the collar 13, for sealing purposes.

These two cover portions, 17*a*, 17*b* are connected to one another by a seam 18 forming a hinge so as to maintain the flexibility of the boot and not to disturb the pivoting of the collar, the cover portion 17*b* being capable of pivoting with respect to the cover portion 17*a* affixedly with the collar.

As shown in FIG. 4, the cover portion 17*a* can, in a known manner, be opened in two portions by means of a zip fastener 21 to allow access to the lacing system 20 of the boot.

The return element or element 25 of the collar 13 is, in the example shown, made of a double pin having two arms, one upper arm 26 in support against the lower edge 13*b* of the collar, and one lower arm 27 in support against an associated abutment surface 31 of the rear stiffener 12 of the upper.

Furthermore, the element 25 passes around the journal axis 19 of the collar to be maintained in place.

This is biased, elastic return device 25 has an active phase, i.e., during a rearward pivoting of the collar from a substantially vertical median equilibrium position thereof, which is defined by the axis O–O' in the Figure, and thus exerts, during such a pivoting of the collar, a force for returning this collar frontwardly.

Consequently, the frontward pivoting of the collar is completely free, i.e., the elastic return device 25 has an inactive phase, whereas its rearward pivoting occurs against the elastic return device 25 which conversely facilitates the frontward return of the collar.

Figure 5:
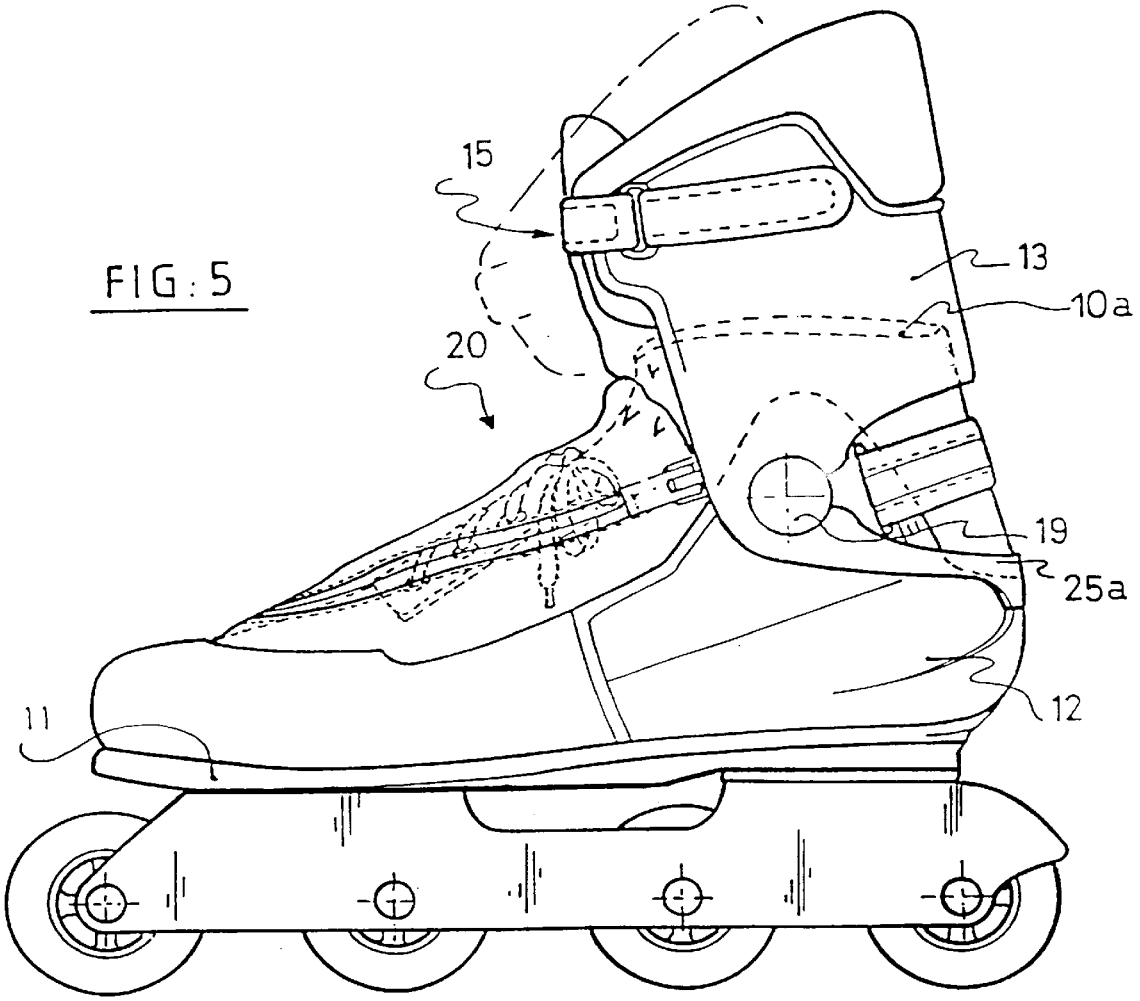
FIG. 5 is a perspective view of a boot according to another embodiment.

Of course, the elastic return element 25 could be made in a totally different manner, the essential purpose being that it exerts a return force on the collar during the rearward pivoting thereof. For example, it could be a spring of a different type, such as a coil spring, elastic buffer, . . . etc. This elastic element could also be designed to be integral with one of the elements of the upper, and, as shown in FIG. 5, the elastic return element could thus be constituted by an elastic arm 25*a* extending from the journalled collar 13 and cooperating with an abutment provided on the rear stiffener, or another portion of the upper 10. Conversely, it could also be an elastic arm extending from the rear stiffener of the upper and cooperating with an associated abutment of the collar.

In any event, such an arrangement tends to help the muscle of the leg which controls the lifting of the tip of the foot with respect to the leg, and therefore makes it possible to limit the fatigue thereof during the sport activity.

Another important advantage of this elastic return element is that it provides the leg of the athlete with a sort of rear support with a progressive resistance, and especially that it provides the latter with a rearward referencing of the position of his or her leg, i.e., it allows the athlete to locate the position of the leg with respect to the vertical, a very important item of information for maintaining the balance in such a gliding sport.

Of course, the present invention is not limited to the examples of embodiment described hereinabove, but also encompasses any similar or equivalent embodiments.

The instant application is based upon French Patent Application No. 95 13899, filed on Nov. 20, 1995, the disclosure of which is hereby expressly incorporated by reference thereto, and the priority of which is hereby claimed under 35 U.S.C. §119.

What is claimed is:

1. A roller skate comprising:

a frame;

a plurality of wheels connected to said frame; and a boot having heel and toe portions, said heel and toe portions being affixed with respect to said frame, said boot comprising:

a rigid sole;

a low upper affixed to said rigid sole, said low upper comprising a rigid heel stiffener and a main soft portion made of flexible and breathable material; and a rigid collar and a journal connection between said rigid collar and said rear heel stiffener, said rigid collar extending upwardly from said heel stiffener to provide lateral guidance and holding of a user's ankle;

said rigid collar being independent of said main soft portion of said low upper so as to pivot freely at least forwardly with respect to said heel stiffener.

2. A roller skate according to claim 1, wherein:

said journal connection is located substantially in a malleoli area of the user's leg.

3. A roller skate according to claim 1, further comprising:

an elastic return device positioned to exert a return force on said rigid collar during rearward pivoting of said rigid collar.

4. A roller skate according to claim 3, wherein:

said elastic return device includes an active phase and an inactive phase, said inactive phase corresponding to movement of said rigid collar between a substantially vertical medium equilibrium position and forwardly from said position.

5. A roller skate according to claim 4 wherein:

said elastic return device comprises an upper arm in abutment with said rigid collar and a lower arm in abutment with said upper, said elastic return device being biased during said active phase as said rigid collar is moved rearwardly from said substantially vertical medium equilibrium position.

6. A roller skate according to claim 3, wherein:

said elastic return device comprises at least one elastic arm extending from one of said collar and said upper and cooperating with an abutment formed on the other of said collar and said upper.

7. A roller skate according to claim 3 wherein:

said elastic return device comprises an elastic arm made unitary with said collar, said rigid heel stiffener comprising an abutment, said elastic arm being positioned for abutting against said abutment during rearward pivoting of said collar.

8. A roller skate according to claim 1, wherein:

said journal connection between said rigid collar and said rear heel stiffener is a removable connection.

9. A roller skate according to claim 1, wherein:

said rigid collar extends upwardly said heel stiffener to a position corresponding approximately to mid-leg of the user.

10. A roller skate according to claim 1, wherein:

said collar is provided internally with a lining, said lining having an internal surface extending continuously with an internal surface of said upper.

11. A roller skate according to claim 1, wherein:

said upper is provided with a tongue, said tongue extending rearwardly to a flexion fold area of the user's foot.

12. A roller skate according to claim 1, wherein:

said boot further includes a tightening system; and said upper further includes a cover over said tightening system.

13. A roller skate according to claim 12, wherein:

said rigid collar includes a front opening;

a flexible extension extends upwardly from said cover to cover said front opening of said rigid collar.

14. A roller skate according to claim 13, wherein:

said flexible extension is connected to said cover at a seam, said seam forming a hinge.

15. A roller skate comprising:

a frame;

a plurality of wheels connected to said frame; and a boot having heel and toe portions, said heel and toe portions being affixed with respect to said frame, said boot comprising:

a rigid sole;

a rigid heel stiffener;

a rigid collar articulated to said rigid heel stiffener, said rigid collar extending upwardly from said rigid heel stiffener to provide lateral holding of a user's ankle;

an upper attached fixedly to said rigid sole, said upper having a portion made of a substantially soft breathable material; and a lining affixed only to said rigid collar to allow said rigid collar to pivot freely at least forwardly relative to said soft upper and independently of said soft upper.

16. A roller skate according to claim 15, wherein:

said journal connection is located substantially in a malleoli area of the user's leg.

17. A roller skate according to claim 15, further comprising:

an elastic return device positioned to exert a return force on said rigid collar during rearward pivoting of said rigid collar.

18. A roller skate according to claim 17, wherein:

said elastic return device includes an active phase and an inactive phase, said inactive phase corresponding to movement of said rigid collar between a substantially vertical medium equilibrium position and forwardly from said position.

19. A roller skate according to claim 18, wherein:

said elastic return device comprises an upper arm in abutment with said rigid collar and a lower arm in abutment with said upper, said elastic return device being biased during said active phase as said rigid collar is moved rearwardly from said substantially vertical medium equilibrium position.

20. A roller skate according to claim 17, wherein:

said elastic return device comprises at least one elastic arm extending from one of said collar and said upper and cooperating with an abutment formed on the other of said collar and said upper.

21. A roller skate according to claim 17, wherein:

said elastic return device comprises an elastic arm made unitary with said collar, said rigid heel stiffener comprising an abutment, said elastic arm being positioned for abutting against said abutment during rearward pivoting of said collar.

22. A roller skate according to claim 15, wherein:

said rigid collar extends upwardly said heel stiffener to a position corresponding approximately to mid-leg of the user.

23. A roller skate according to claim 15, wherein:

said upper is provided with a tongue, said tongue extending rearwardly to a flexion fold area of the user's foot.

24. A roller skate according to claim 15, wherein said boot further includes a tightening system;

said upper further includes a cover over said tightening system.

25. A roller skate according to claim 24, wherein:

said rigid collar includes a front opening;

a flexible extension extends upwardly from said cover to cover said front opening of said rigid collar.

26. A roller skate according to claim 25, wherein:

said flexible extension is connected to said cover at a seam, said seam forming a hinge.

27. A roller skate according to claim 15, wherein:

said substantially soft breathable material is a textile material.

28. A roller skate comprising:

a frame;

a plurality of wheels connected to said frame; and a boot having heel and toe portions, said heel and toe portions being affixed with respect to said frame, said boot comprising:

a rigid sole;

a rigid heel stiffener;

a rigid collar journalled on said rigid heel stiffener to provide lateral guidance and holding of a user's ankle; and an upper attached to said rigid sole, said upper having a portion made of a substantially soft breathable material; and said rigid collar being independent of said upper and extending upwardly above at least a substantial portion of said upper so as to pivot freely at least forwardly with respect to said upper.

29. A roller skate according to claim 28, further comprising:

an elastic return device positioned to exert a return force on said rigid collar during rearward pivoting of said rigid collar.

30. A roller skate comprising:

a frame;

a plurality of wheels connected to said frame; and a boot having heel and toe portions, said heel and toe portions being affixed with respect to said frame, said boot comprising:

a rigid sole;

a rigid heel stiffener;

an upper having a lower end affixed to said rigid sole and an upper end demarcating a peripheral edge surrounding at least partially a user's foot, said upper having a portion made of a substantially soft breathable material; and a rigid collar journalled on said rigid heel stiffener to provide lateral guidance and holding of a user's ankle;

said rigid collar being independent of said upper and extending upwardly above said peripheral edge of said upper end so as to pivot freely at least forwardly with respect to said upper.

31. A roller skate according to claim 30, further comprising:

an elastic return device positioned to exert a return force on said rigid collar during rearward pivoting of said rigid collar.

32. A roller skate comprising:

a frame;

a plurality of wheels connected to said frame; and a boot having heel and toe portions, said heel and toe portions being affixed with respect to said frame, said boot comprising:

a rigid sole;

a rigid heel stiffener;

a soft, pliable, and breathable upper affixed to said rigid sole;

a rigid collar journalled on said heel stiffener, said rigid collar extending upwardly, at an equilibrium position, from said heel stiffener to provide lateral guidance and holding of a user's ankle; and an elastic device opposing a biasing force applied to said collar between the equilibrium position and a rearward pivoting position so as to provide a rearward pivoting referencing position of a leg of the user.

33. A roller skate according to claim 32, wherein:

said elastic return device includes an active phase and an inactive phase, said inactive phase corresponding to movement of said rigid collar between a substantially vertical medium equilibrium position and forwardly from said position.

34. A roller skate according to claim 33, wherein:

said elastic return device comprises an upper arm in abutment with said rigid collar and a lower arm in abutment with said upper, said elastic return device being biased during said active phase as said rigid collar is moved rearwardly from said substantially vertical medium equilibrium position.

35. A roller skate according to claim 32, wherein:

said elastic return device comprises at least one elastic arm extending from one of said collar and said upper and cooperating with an abutment formed on the other of said collar and said upper.

36. A roller skate according to claim 32, wherein:

said elastic return device comprises an elastic arm made unitary with said collar, said rigid heel stiffener comprising an abutment, said elastic arm being positioned for abutting against said abutment during rearward pivoting of said collar.

* * * * *